US007272350B2

(12) United States Patent
Pargett

(10) Patent No.: US 7,272,350 B2
(45) Date of Patent: Sep. 18, 2007

(54) METHOD FOR POSITIONING TRANSFER MEMBERS WITHIN AN IMAGE FORMING APPARATUS

(75) Inventor: Stacy M. Pargett, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 203 days.

(21) Appl. No.: 11/127,407

(22) Filed: May 12, 2005

(65) Prior Publication Data

US 2006/0257178 A1 Nov. 16, 2006

(51) Int. Cl.
*G03G 15/01* (2006.01)
*G03G 15/16* (2006.01)
*G03G 15/00* (2006.01)

(52) U.S. Cl. ..... 399/302; 399/66; 399/167; 399/303

(58) Field of Classification Search ..... 399/66, 399/297, 299, 300, 302, 303, 316, 317, 167
See application file for complete search history.

(56) References Cited

U.S. PATENT DOCUMENTS

| | | | | |
|---|---|---|---|---|
| 4,056,315 | A | 11/1977 | Ariyama et al. | |
| 5,444,522 | A | 8/1995 | Owens, Jr. | |
| 5,873,013 | A | 2/1999 | Matsushita et al. | |
| 6,148,159 | A | 11/2000 | Shiraishi | |
| 6,681,095 | B1 | 1/2004 | Tsuda | |
| 2003/0223785 | A1 * | 12/2003 | Kanekura et al. | 399/299 |

OTHER PUBLICATIONS

Statement of Stacy Pargett.

* cited by examiner

*Primary Examiner*—Hoang Ngo
(74) *Attorney, Agent, or Firm*—Coats & Bennett, PLLC

(57) ABSTRACT

A method of moving a transfer member from a first image transfer position to a second non-image transfer position after transfer of a toner image. This method reduces toner and photoconductor drum degradation in image forming apparatuses.

15 Claims, 6 Drawing Sheets

METHOD FOR POSITIONING TRANSFER MEMBERS WITHIN AN IMAGE FORMING APPARATUS

BACKGROUND

The present invention relates generally to the field of image forming apparatuses and in particular to an image forming apparatus that reduces toner and photoconductor degradation during an image formation cycle. Embodiments of the present invention move a transfer member from a first image transfer position to a second non-image transfer position after transfer of a toner image to an image transfer media.

In an electrophotographic image forming apparatus toner degrades as it is worked by the rotation of agitator members during rotation of a photoconductive member and developer section. The effects of toner degradation are directly related to the quality of image formation. Toner degradation particularly reduces the quality of image formation where the toner has been churned and degraded by the toner agitating members but there has been no toner transfer to an image transfer media or media sheet. In this instance, the toner remains in the toner cartridge and is subject to further degradation by the agitating members during subsequent image formation cycles. This is particularly a concern with color toner cartridges which generally are not as frequently used as the black toner cartridge.

Photoconductor life is generally related to the number of photoconductor revolutions. Revolutions may occur both when a toner image is transferred from the photoconductor, and also when there is no transfer. Each instance may cause surface degradation, thereby reducing the number image transfers the photoconductor will be competent to complete.

SUMMARY

The present invention relates to embodiments for moving a transfer member from a first image transfer position to a second non-image transfer position after transfer of a toner image to an image transfer medium. This prevents toner and photoconductor drum degradation in image forming apparatuses.

In one embodiment the method comprises the steps of positioning a first transfer member at an image transfer position, and positioning a second transfer member at the image transfer position. A first toner image is transferred to an image transfer medium at the first transfer member, and a second toner image is transferred to an image transfer medium at the second transfer member. After transferring their respective toner images, the first and second transfer members may be moved to a non-transfer position.

The first transfer member may be moved to the non-image transfer position prior to or after the toner image is transferred at the second transfer member. The transfer members may be moved individually at separate times, or simultaneously.

After moving the transfer members to the non-image transfer position spaced away from the image transfer medium, a plurality of toner cartridge drive motors may be shut off to reduce toner and photoconductor degradation.

DETAILED DESCRIPTION

The present invention relates to embodiments for moving a transfer member from a first image transfer position to a second non-image transfer position after transfer of a toner image to an image transfer media. This reduces toner and photoconductor drum degradation in image forming apparatuses.

As the present invention relates to a method of moving a transfer member within an image forming apparatus, an understanding of the basic elements of an electrophotographic image forming apparatus may aid in comprehending the present invention. For purposes of illustration, a four cartridge color laser printer will be described. However one skilled in the art will understand that the present invention is applicable to other types of electrophotographic image forming apparatuses that create images using one or more toner cartridges. Further, the term "media sheet" is used generally herein to refer to various types of output media that ultimately receives the toner image or images, such as paper sheet, envelopes, transparencies, card stock, postcards, and the like.

Figure 1:
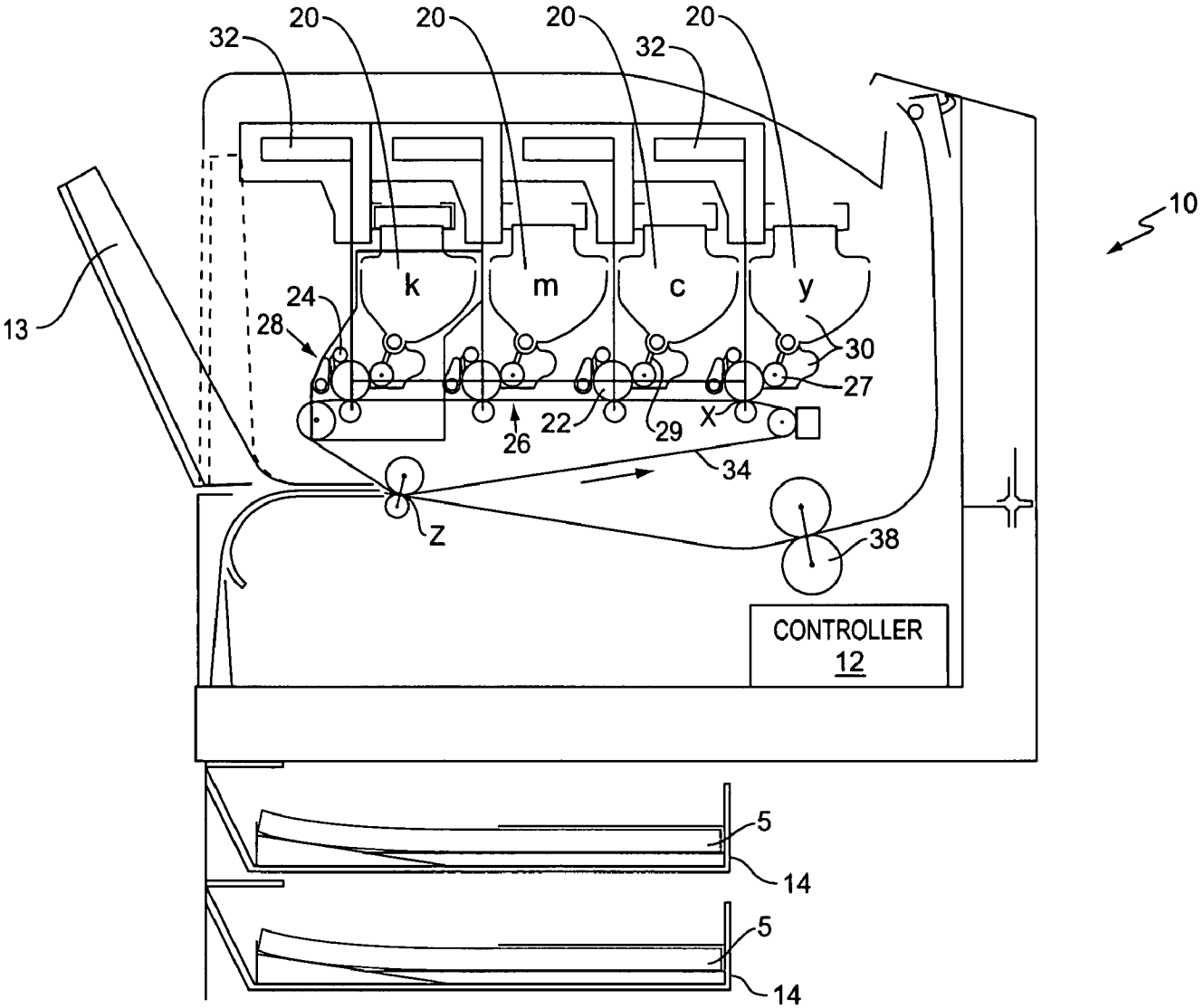
FIG. 1 is a side cut-away view illustrating the elements of an image forming apparatus according to one embodiment of the present invention.
Figure 2:
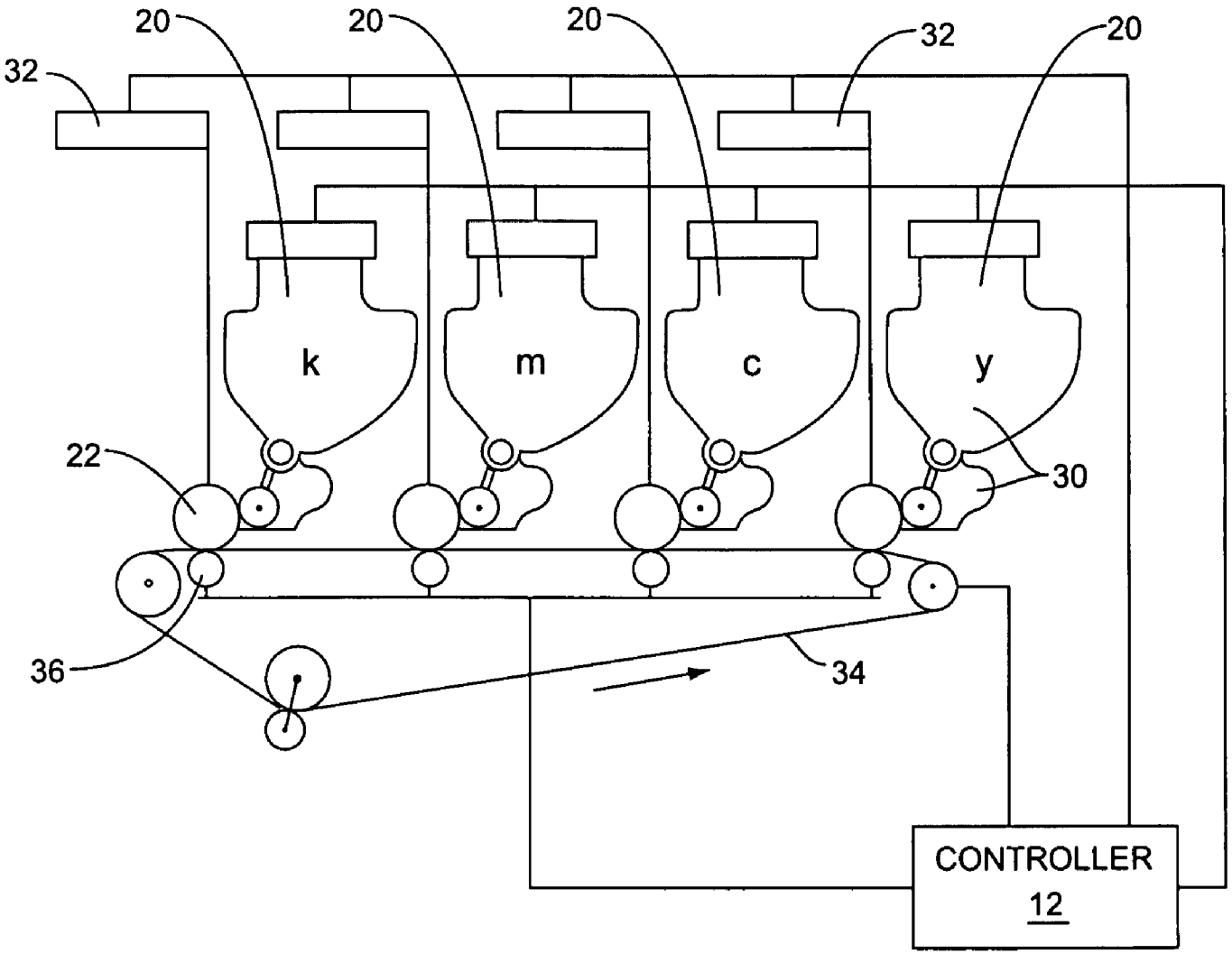
FIG. 2 is a detailed side cut-away view illustrating some of the internal elements of an image forming apparatus of FIG. 1.

With reference to FIGS. 1 and 2, a four color laser printer, generally designated 10, typically includes a plurality of optionally removable toner cartridges 20 that have different toner color contained therein, an image transfer medium 34, a fuser 38, and one or more media sheet supply trays 14. For instance, the printer 10 may include a black (k) cartridge 20, a magenta (m) cartridge 20, a cyan (c) cartridge 20, and a yellow (y) cartridge 20. Typically, each different color of toner forms an individual toner image of a single color that are combined to create the final multi-colored image. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22, a charger 24, a developer section 26, a cleaning assembly 28, and a toner supply bin 30. The toner supply bin 30 includes one or more agitating members that agitate the toner and move it towards the developer section 26. The photoconductor 22 is generally cylindrically-shaped with a smooth surface for receiving an electrostatic charge over the surface as the photoconductor 22 rotates past charger 24. The photoconductor 22 rotates past a scanning laser 32 directed onto a selective portion of the photoconductor surface forming an electrostatically latent image representative of the image to be printed.

After receiving the latent image, the photoconductor 22 rotates through the developer section 26 where toner from a developer roller 27 is uniformly transferred to the latent image on the photoconductor 22. The toner is typically a fine powder that is attracted and clings to the areas of the photoconductor 22 that have been discharged by the scanning laser 32. One or more agitating members (not shown) are positioned within the reservoir 30 for agitating and moving the toner towards the developer section 26. In one embodiment, the agitating members are elongated arms rotatably positioned within the toner reservoir.

Each cartridge 20 is driven by a toner cartridge drive (not illustrated) that rotates the members within the cartridge. The drive may be positioned in the main body of the image forming apparatus. Installation of each cartridge into the main body operatively connects the cartridge with the drive gear. Each cartridge may be driven by a separate drive, or two or more cartridges may be driven by a single drive. In one embodiment, the cartridge is driven by the same drive system that rotates the ITM 34.

The photoconductor 22 next rotates past an exterior surface of an adjacently-positioned image transfer medium ("ITM") 34. A transfer member 36 is positioned adjacent an interior surface of the ITM 34 in substantial alignment with the photoconductor 22. Transfer member 36 transfers toner from the photoconductor 22 to ITM 34 via a voltage vector. The location of this transfer from the photoconductor 22 to the ITM 34 about transfer member 36 is called the first image transfer point (denoted X in FIG. 1).

The ITM 34, each photoconductor 22, and transfer members 36 are synchronized by controller 12, via gears and the like to allow the toner from each cartridge 20 to precisely align on the ITM 34 during a single pass. By way of example as viewed in FIG. 1, the yellow toner will be placed on the ITM 34, followed by cyan, magenta, and black. The toner images may be placed in an overlapping arrangement, or may be separately spaced apart on the ITM 34. In a monochromatic image, only a single toner image is transferred to the ITM 34.

As illustrated in FIGS. 1 and 2, the ITM 34 comprises an endless belt 34 that extends around a series of rollers. The ITM 34 receives the toner images from one or more of the photoconductors 22 and transports them to a second transfer point Z where the toner image(s) are transferred to a media sheet.

The media sheet 5 may be stored in supply tray 14 or a manual feed 13, and supplied, via a suitable series of rollers, belts, and the like, to the second transfer point Z. At this location the toner image(s) on the ITM 34 is transferred to the media sheet 5. The media sheet 5 and attached toner next travel through a fuser 38, typically a pair of rollers with an associated heating element, which heats and fuses the toner to the media sheet 5. The media sheet 5 with the fused image is then transported out of the printer 10 for receipt by a user, or sent through a duplex path for image formation on the second side. After rotating past the second transfer point Z, the ITM 34 is cleaned of residual toner by a cleaning assembly. The process is then repeated for each additional image formation process.

The ITM 34 extends around, and is driven by, a set of rollers. In one embodiment the rollers comprise a drive roller, a tension roller, and an idler roller. The tension roller is spring loaded, and acts to maintain a predetermined tension on the ITM 34. In this embodiment the tension roller adjustably compensates for variable tension on the ITM 34. As the transfer members 36 are positioned back and forth between the image transfer position 37A and the non-image transfer position 37B, the tension roller adjustably compensates to maintain the predetermined tension on the ITM 34.

Figure 3A:
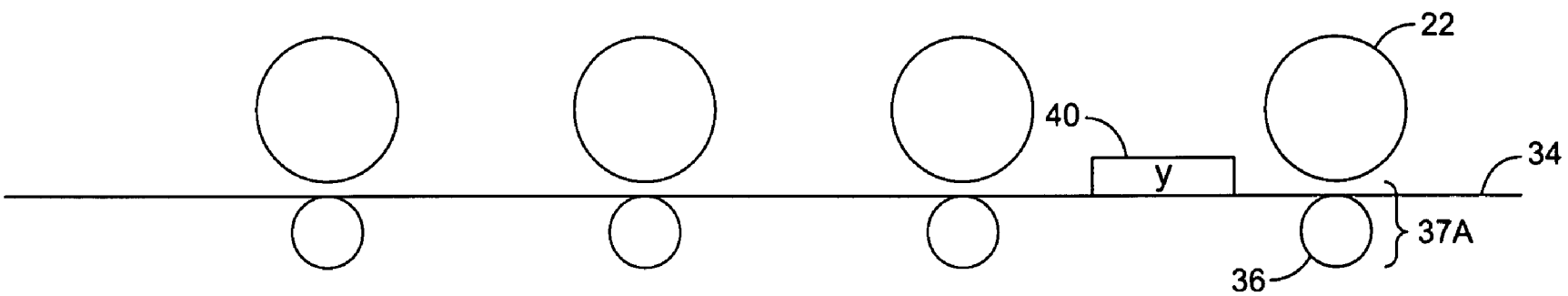
FIGS. 3A and 3B are schematic views illustrating the process of moving transfer members from a first image transfer position to a second non-image transfer position according to one embodiment of the present invention.
Figure 5A:
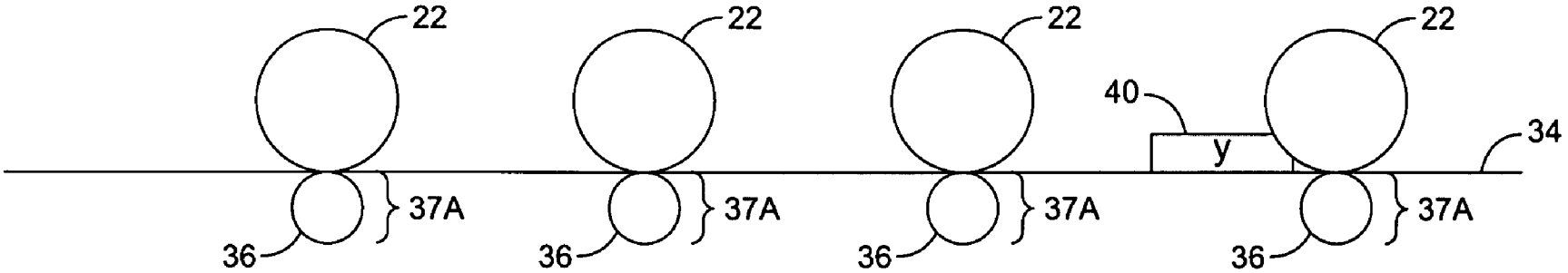
FIGS. 5A-5D are schematic views illustrating the movement of the transfer members according to one embodiment of the present invention.
Figure 5B:
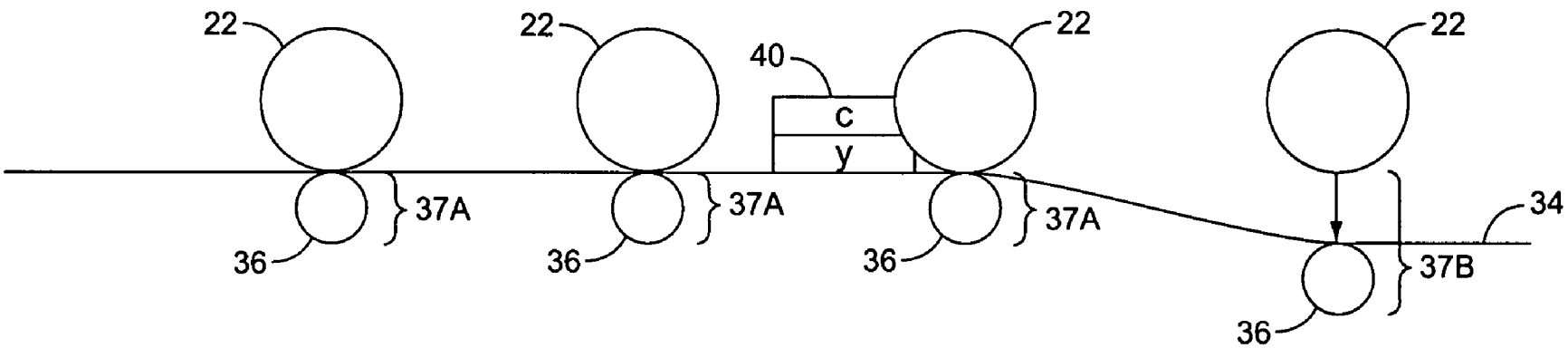
Figure 5C:
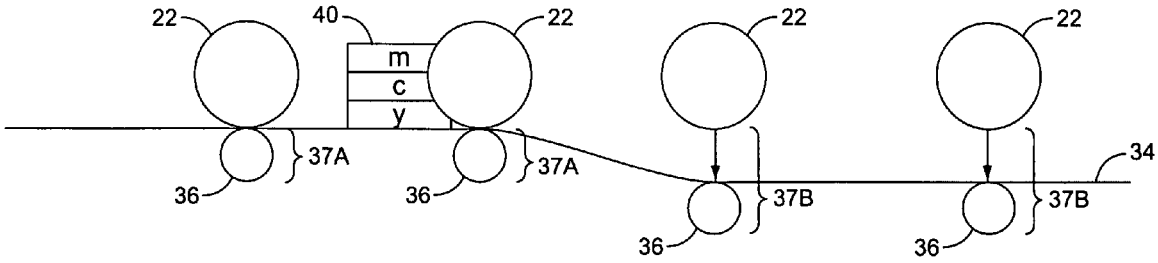
Figure 5D:
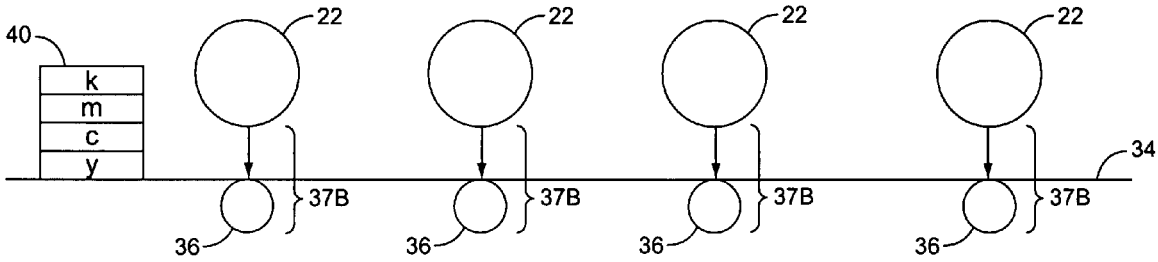

The transfer members 36 are adjustably positionable between a first image transfer position 37A and a second non-image transfer position 37B. At the first image transfer position 37A, the transfer members 36, in combination with the tension roller, place the ITM 34 adjacent the photoconductor 22. The transfer position may include the ITM 34 being in close proximity to the photoconductor 22 as illustrated in FIG. 3A, or in actual contact with the photoconductor 22 as illustrated in FIG. 5A. At the second non-image transfer position 37B, the transfer members 36, in combination with the tension roller, space the ITM 34 away from the photoconductor 22. The toner cartridge drive can be shut-off when the ITM 34 is spaced from the photoconductor at the second non-image transfer position 37B thus reducing toner and photoconductor degradation.

Figure 3B:
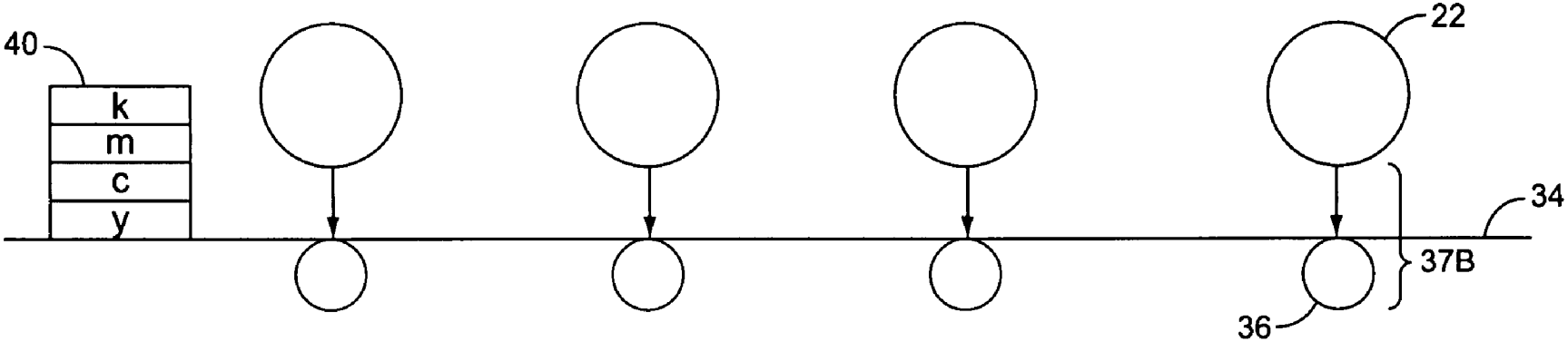

FIGS. 3A and 3B illustrate one embodiment of the present invention. In FIG. 3A, the beginning of an image formation cycle is illustrated with transfer members 36 at a first image transfer position 37A with the ITM 34 adjacent the photoconductor 22. In the embodiment illustrated in FIG. 3A, the ITM 34 is positioned in proximity to but spaced apart from the photoconductor 22. Toner image 40, designated as yellow toner (y), is transferred at the upstream transfer member 36 to the ITM 34.

In FIG. 3B, additional toner images 40, designated as cyan (c), magenta (m), and black (k), corresponding to the toner carried by the remaining downstream toner cartridges 20, have been similarly transferred at each of the corresponding transfer members 36 to the ITM 34 in an overlapping relationship. In this embodiment, the photoconductors 22 each remain at the image transfer positions 37A during toner transfer.

After transfer of the toner to the ITM 34, each transfer member 36 is then moved to a second non-image transfer position 37B. This causes the ITM 34 to also become further spaced apart from the ITM 34. By moving each of the transfer members 36 to a non-image transfer position 37B with the ITM 34 nonadjacent the photoconductor 22, the toner cartridge drives may be selectively shut off by the controller 12. This stops rotation of the members within the cartridge 20, including the toner agitating member and photoconductor 22, thereby decreasing the rate of toner and photoconductor degradation.

Figure 4:
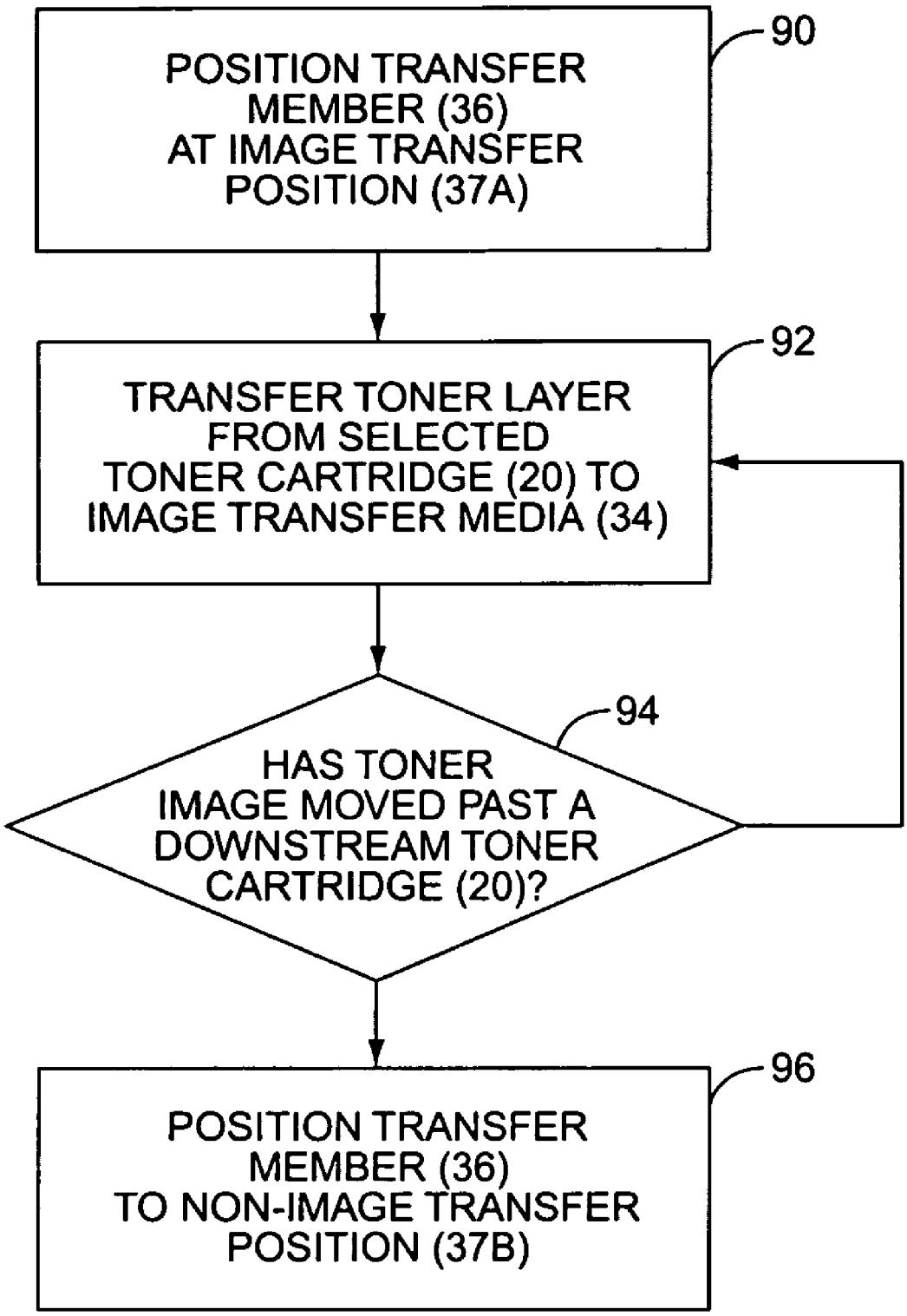
FIG. 4 is a schematic flow diagram illustrating the process of moving the transfer members from a first image transfer position to a second non-image formation position according to one embodiment of the present invention.

FIG. 4 is a schematic flow diagram illustrating an embodiment whereby the transfer members 36 may be independently moved to a second non-image transfer position 37B after a corresponding toner image has been transferred to the ITM 34.

With reference to FIGS. 4, and 5A-5D, to initiate the image formation cycle, the transfer members 36 are moved into an image transfer position 37A with the ITM 34 adjacent the photoconductor 22 (Step 90). This initial movement of the transfer member 36 to the image formation position 37A may be performed at the beginning of the image formation cycle, or may comprise the last step of the image formation cycle to effectively "reset" the photoconductor 22 adjacent a stopped ITM 34 in anticipation of the next image formation cycle.

Toner is then transferred from each selected toner cartridge 20 to the ITM 34 (Step 92). Next it is determined whether the transfer member 36 has transferred its corresponding toner image 40 to the ITM 34, or the toner image 40 has moved past the corresponding downstream cartridge 20 (Step 94). If this has not occurred, the transfer member 36 remains in the image transfer position. If this has occurred, the transfer member 36 independently moves to a non-image transfer position 37B (Step 96).

By independently moving each of the transfer members 36 to a non-image transfer position 37B with the ITM 34 spaced from the photoconductor 22, the toner cartridge drives may be selectively shut off by the controller 12. This decreases the rate of toner and photoconductor degradation.

As previously stated, one embodiment comprises multiple cartridges being driven by a common drive. With this embodiment, the drive may include a clutch for the toner cartridges 20 to selectively operatively engage and disengage the drive to each cartridge. By way of examples and using the setup of FIG. 5A, the yellow and cyan cartridges 20 may be driven by a common drive. The drive initially causes each to rotate prior to image formation. After the yellow image has been placed on the ITM 34, the yellow transfer member 36 may be moved to the non-image transfer position 37B and the clutch may disengage drive to the yellow cartridge while still allowing for drive to the cyan cartridge. After the cyan toner image is placed on the ITM 34, the cyan transfer member 36 is moved to the non-image transfer position 37B and the drive may be shut off. The drive that operates the yellow and cyan cartridges may be shut off as the drive to the remaining cartridges continues.

By extending the photoconductor life the current photoconductor diameter could be reduced in size. Currently the photoconductors 22 may be constructed with photoconductor degradation in mind. To mitigate this known degradation, the photoconductor diameter is configured to reduce the number of photoconductor revolutions during an image formation cycle. Typically this is accomplished by creating a photoconductor drum with a large diameter so that the number of photoconductor revolutions required per media sheet is optimized.

The discussion above has been in the context of a conventional multi-color laser printer 10 for illustrative purposes; however, it should be noted that the present invention is not so limited and may be used in any electrophotographic system, including laser printers, copiers, and the like. Additionally, the methods and devices may also be used in a direct transfer system. In this embodiment, the ITM 34 acts as a transfer mechanism to move media sheets past each of the photoconductors 22. The toner images are placed directly on the media sheets without the need for a second transfer.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of forming an image in an image forming apparatus, comprising the steps of:

positioning a plurality of photoconductive members within the image forming apparatus;

transferring toner at each of the plurality of photoconductive members to an image transfer medium while a plurality of toner transfer members are at a first position;

positioning each of the plurality of transfer members at a second position after transfer of toner to the image transfer media without moving the plurality of photoconductive members;

stopping drive to at least one of the plurality of photoconductive members after moving the plurality of transfer members to the second position; and clutching a motor that drives the at least one of the plurality of photoconductive members and at least one other of the plurality of photoconductive members and continuing to rotate the at least one other of the plurality of photoconductive members.

2. The method of claim 1, wherein the step of positioning the plurality of toner transfer members at the first position places the image transfer medium adjacent to the plurality of photoconductive members.

3. The method of claim 1, wherein the step of positioning the plurality of toner transfer members at the first position places the image transfer medium in contact with the photoconductive members.

4. The method of claim 1, wherein the step of transferring toner at each of the plurality of photoconductive members to the image transfer medium comprises transferring the toner directly to a media sheet.

5. The method of claim 1, further comprising transferring the toner from the image transfer medium to a media sheet at a second transfer position.

6. The method of claim 1, further comprising the step of transferring black toner to the image transfer medium when the plurality of toner transfer members are at the first position.

7. A method of forming an image in an image forming apparatus, comprising the steps of:

positioning a first color photoconductive member and a second black photoconductive member;

positioning a first transfer member at an image transfer position adjacent to the first color photoconductive member;

positioning a second transfer member at the image transfer position adjacent to the second black photoconductive member;

transferring a first color toner image from the first color photoconductive member to an image transfer medium;

transferring a second black toner image from the second black photoconductive member to the image transfer medium;

moving the first and second transfer members to a non-image transfer position and maintaining the position of the first color photoconductive member and the second black photoconductive member;

stopping rotation of the first color photoconductive member after moving the first transfer member to the non-image transfer position; and clutching a motor that drives the first color photoconductive member and the second black photoconductive member and continuing to rotate the second black photoconductive member.

8. The method of claim 7, further comprising the step of moving the first transfer member to the non-image transfer position prior to transferring toner from the second black photoconductive member.

9. The method of claim 7, further comprising the step of simultaneously moving the first transfer member and the second transfer member to the non-image transfer position.

10. The method of claim 9, further comprising the step of moving the first transfer member and the second transfer member to the non-image transfer position after transferring toner from the second black photoconductive member.

11. The method of claim 7, wherein the steps of positioning the first transfer member and the second transfer member at the image transfer position comprises placing the image transfer medium spaced away from the first color photoconductive member and the second black photoconductive member.

12. The method of claim 7, wherein the steps of positioning the first transfer member and the second transfer member at the image transfer position comprises placing the image transfer medium in contact with the first color photoconductive member and the second black photoconductive member.

13. A method of forming an image in an image forming apparatus, comprising the steps of:

positioning a first transfer member at an image transfer position adjacent to a first photoconductive member;

positioning a second transfer member at the image transfer position adjacent to a second photoconductive member;

transferring a first toner image from the first photoconductive member to an image transfer medium at the first transfer member;

moving the first transfer member to a non-image transfer position without moving the first photoconductive member;

stopping rotation of the first photoconductive member;

clutching a motor that drives the first and second photoconductive members and continuing to rotate the second photoconductive member;

transferring a second toner image from the second photoconductive member to the image transfer medium at the second transfer member; and moving the second transfer member to the non-image transfer position without moving the second photoconductive member.

14. A method of forming an image in an image forming apparatus, comprising the steps of:

forming a first toner image on an image transfer medium at a first position;

after forming the first toner image, moving a first transfer member at the first position from an image transfer position with the image transfer medium adjacent to a first photoconductive member to a non-image transfer position with the image transfer medium spaced apart from the first photoconductive member;

stopping rotation of the first photoconductive member after moving the first transfer member to the non-image transfer position;

clutching a motor that drives the first photoconductive member and a second photoconductive member and continuing to rotate the second photoconductive member;

moving the image transfer medium to a second downstream position;

forming a second toner image on the image transfer medium at the second downstream position; and after forming the second toner image, moving the second transfer member from the image transfer position with the image transfer medium adjacent to the second photoconductive member to a non-image transfer position with the image transfer medium spaced apart from the second photoconductive member.

15. The method of claim 14, further comprising the step of moving the first transfer member from the non-image transfer position to the image transfer position prior to forming the first toner image.

* * * * *